US006320452B1

(12) United States Patent
Chen

(10) Patent No.: US 6,320,452 B1
(45) Date of Patent: Nov. 20, 2001

(54) FLOATING POWER SUPPLY USING DUAL NPN TRANSISTOR

(75) Inventor: Angus Chen, Hsin-Chu (TW)

(73) Assignee: Youngtek Electronics, Hsin-Chu (TW)

( * ) Notice: Subject to any disclaimer, the term of this patent is extended or adjusted under 35 U.S.C. 154(b) by 0 days.

(21) Appl. No.: 09/690,707

(22) Filed: Oct. 18, 2000

(51) Int. Cl.[7] ..... G05F 1/10
(52) U.S. Cl. ..... 327/530; 327/535; 327/540
(58) Field of Search ..... 327/538, 530, 327/540, 542, 533, 555, 545, 427, 24

(56) References Cited

U.S. PATENT DOCUMENTS 5,418,674 * 5/1995 Davies et al. ..... 361/18
5,552,746 * 9/1996 Danstrom ..... 327/427
6,049,234 * 4/2000 Miyashita et al. ..... 327/24

* cited by examiner

*Primary Examiner*—Tuan Lam
*Assistant Examiner*—Hiep Nguyen
(74) *Attorney, Agent, or Firm*—H. C. Lin, Patent Agent

(57) ABSTRACT

A low supply voltage for operating an operational amplifier operating as a voltage follower is derived from a high voltage source. Two npn transistors, two Zener diodes and a current source are connected in series across the high voltage source. The input voltage (to the operational amplifier) plus a Zener reference voltage is applied to the base of the transistor near the positive terminal of the high voltage source. Then, a low positive supply voltage V+ nearly equal to the input voltage plus the Zener voltage (Vi+Vz) is derived at the emitter. This low positive supply voltage V− is derived by dropping V+ through the two series Zener diodes to obtain a low negative supply voltage equal to (Vi−Vz).

8 Claims, 3 Drawing Sheets

FLOATING POWER SUPPLY USING DUAL NPN TRANSISTOR

BACKGROUND OF THE INVENTION (1) Field of the Invention

This invention relates to power supply, particularly to a floating power supply for a voltage follower operating from a high voltage source.

(2) Brief Description of the Related Prior Art

A voltage follower usually uses an operational amplifier (OPA) with the input signal voltage applied to the non-inverting input of the OPA and the output of the OPA connected to the inverting input of the OPA as shown in FIG. 1. Most integrated operational amplifier operates from a low voltage power supply. When the power supply is derived from a high voltage source, the high voltage source must be shifted down to a lower supply voltage for operating the OPA.

A prior art circuit for stepping down the supply voltage in operating the OPA 10 as a voltage follower is shown in FIG. 1. The input voltage Vi is applied to the non-inverting input terminal of the OPA 10. The output of the OPA 10 is connected to a complementary emitter follower with an npn transistor 122 and a pnp transistor 124. The collector of the npn transistor 122 is connected to a high voltage 120V supply, and the collector of the pnp transistor 124 is connected to a high negative voltage −120V supply. The output voltage Vo is connected the common emitter of the npn transistor 122 and pnp transistor 124. The base of the npn transistor 122 is clamped to the output voltage Vo through a Zener diode 147 which is biased by the high positive voltage +120V power source through the resistor 162. Thus, the base of the npn transistor is biased with a voltage equal to Vi+Vz. The positive supply voltage V+ applied to the OPA 10 is then equal Vi+Vz−Vbe, which is a much lower voltage than the 120V high voltage source, where Vbe is the dc base-to-emitter typically around 0.7 V. Similarly, the negative supply voltage V− applied to the OPA 10 is equal Vi−Vz−Vbe, which is much lower in magnitude than the negative −120V high voltage supply.

Since the collector of the npn transistor 122 is connected to the 120V high voltage supply and if Vo centers around 0V, then the $V_{CE}$ across the npn transistor 122 is around 120V and requires a high voltage npn transistor. Similarly, the large $V_{CE}$ across the pnp transistor 124 requires a high voltage pnp transistor. Unfortunately, high voltage pnp transistors are not as readily available commercially as npn transistors. It is desirable not to use any high voltage pnp transistors. Another drawback is that the high voltage npn transistor 122 and the high voltage pnp transistor 124 should have matching characteristic. While it is easy to find matched npn transistors, it is difficult to find such a matched complementary pair.

SUMMARY OF THE INVENTION

An object of this invention is to provide a low voltage supply for a floating voltage follower from a high voltage source. Another object of this invention is to provide a low voltage supply for an operational amplifier operating as a voltage follower. Still another object of this invention is to provide a low voltage supply for an operational amplifier using all npn transistors.

These objects are achieved by connecting two npn transistors, two Zener diodes and a current source in series across a high voltage source. The input voltage plus a Zener reference voltage is applied to the base of transistor near the positive terminal of the high voltage source. Then a low positive supply voltage nearly equal to the input voltage plus the Zener voltage (Vi+Vz) is derived at the emitter. This low positive supply voltage is dropped by the two series Zener diodes to obtain a low negative supply voltage equal to Vi−Vz.

DETAILED DESCRIPTION OF THE INVENTION

Figure 1:
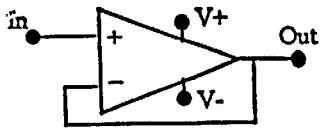
Fig.1 Prior Art
FIG. 1 shows a basic voltage follower using an operational amplifier.
Figure 2:
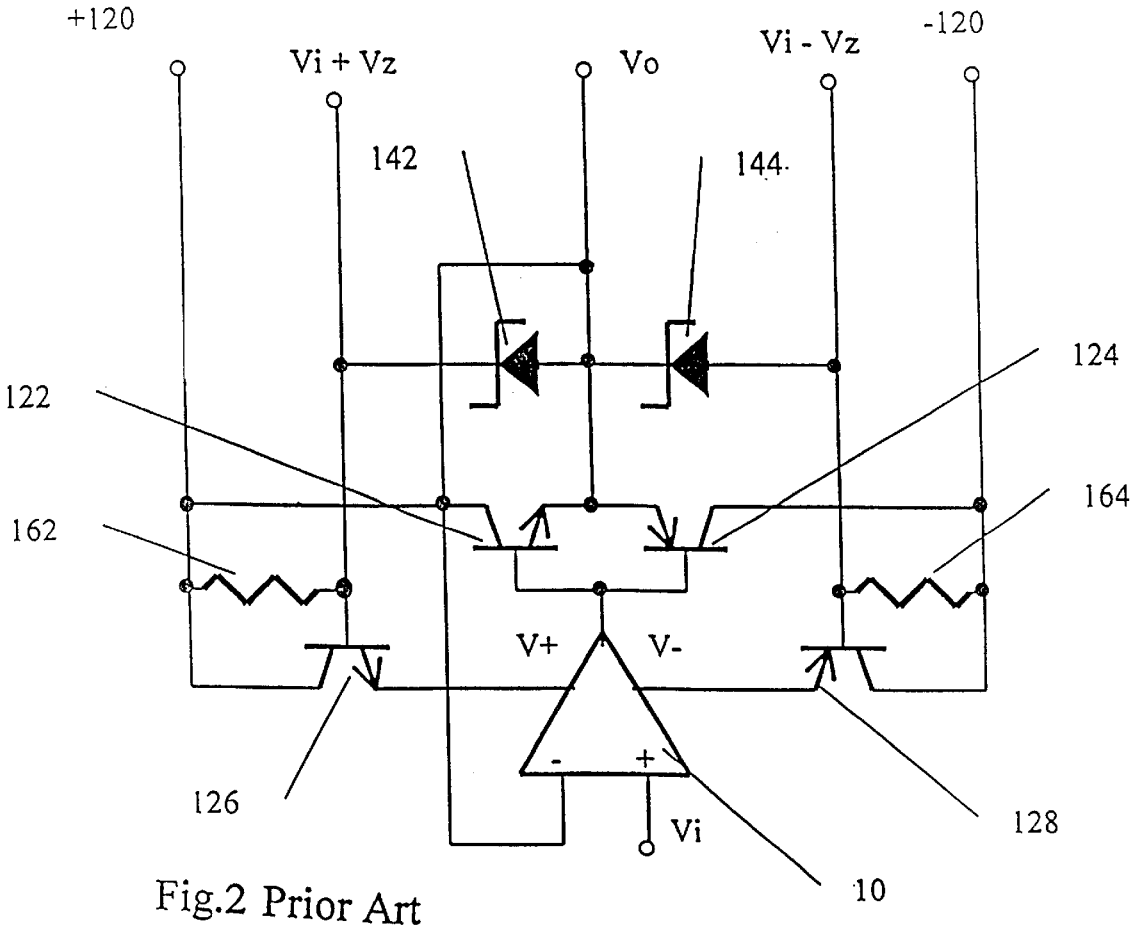
Fig.2 Prior Art
FIG. 2 shows a prior art circuit to obtain a low supply voltage for a voltage follower OPA from a high voltage source.
Figure 3:
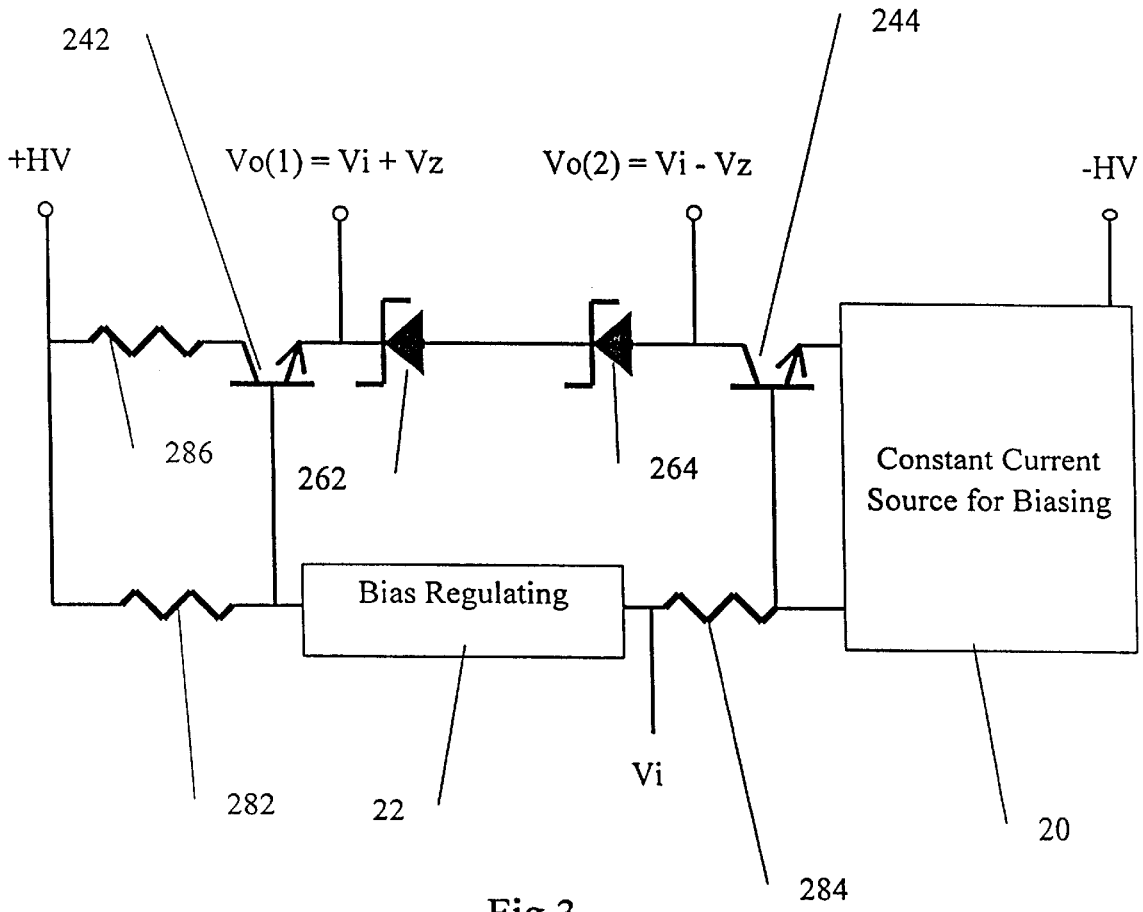
FIG. 3 shows a basic all npn transistor circuit to derive a low supply voltage from a high voltage source.

The basic circuit of the present invention is shown in FIG. 3. Two high voltage npn bipolar transistors (BJT) 242 and 244 are connected in series through two Zener diodes 262, 264 and a constant current source 20 across a high voltage source +HV and −HV. The current source 20 sinks a constant emitter currents of BJT 244 and hence BJT 242. The BJT 242 operates as an emitter follower. The base of BJT 242 is biased above the input voltage Vi by an amount set by the Bias Regulating block 22. If the Bias Regulator adds a bias equal to Vz+Vj , where Vz is a Zener voltage and Vj is voltage drop of a forward biased pn junction, then the voltage at the emitter of BJT 242 is equal to Vi+Vz, since the base-to-emitter voltage drop Vbe is nearly equal to Vj. If all the Zener diodes 262 and 264 have the same Zener voltage Vz, the voltage at the anode of the Zener diode 264 is equal to Vi+Vz−2Vz=Vi−Vz. The voltages Vi+Vx and Vi−Vz can be used as a low voltage supply of a voltage follower operational amplifier as shown in FIG. 1. Since Vi is intermediate between Vi+Vz and Vi−Vz, the operational amplifier can operate satisfactorily over this voltage range. Typical Vz may lie between 6V to 15V is also used to biased the BJT 244 through the resistor 284. Resistor 282 is used to forward bias the BJT 242 from the high voltage supply +HV. The resistor 286 is connected in series with the collector of BJT 242 to reduce the collector to emitter voltage Vce of BJT 242.

Figure 4:
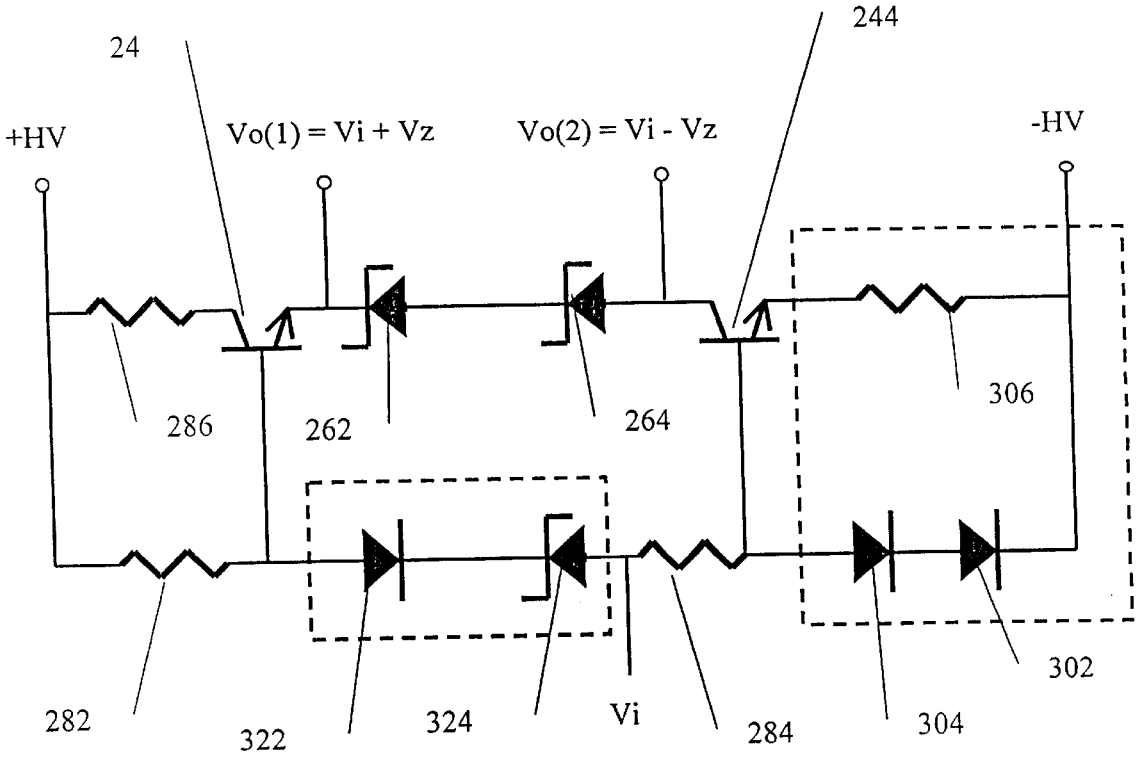
FIG. 4 shows the complete schematic of the basic circuit shown in FIG. 3.

FIG. 4 shows a particular implementation of the circuit shown in FIG. 3. A forward biased diode 322 and a Zener diode 324 with a Zener voltage Vz are connected in series to constitute the Bias Regulator 20, which increases the base voltage of BJT 242 to Vi+Vz+Vj. This voltage is dropped by Vbe at the emitter of BJT 242 to become Vi+Vz, since Vbe=Vj. The current source is furnished by connecting a high resistance 306 in series with the emitter of BJT 244. The base of the BJT 244 is clamped by the two diodes 302 and 304. These diodes are forward biased by a current fed through resistor 282, diode 322, Zener diode 324 and resistor 284. Bias for the base of BJT 242 is tapped from the resistor 282.

In the description of FIG. 3 and FIG. 4, Zener diodes are used as voltage references to yield the Zener voltage. However, reference voltage may also be obtained by connecting a number of forward-biased diodes in series, such as the diode 322 shown in FIG. 4. The diodes may be junction diodes or MOS diodes (by connecting the drain and the gate together). Theoretically, batteries may also be used as voltage references. While the foregoing description uses all npn transistors, a dual circuit using all pnp transistors can also be used. The npn BJT may also replaced with n-channel MOSFETs to obtain the same function. The constant current source in FIG. 3 is not limited to the circuit shown in FIG. 4. Any current source such as the wildly used "current mirror" disclosed in U.S. Pat. No. 3,391,311 may be used.

While the preferred embodiments of the invention have been described, it will be apparent to those skilled in the art that various modifications may be made in the embodiments without departing from the spirit of the present invention. Such modifications are all within the scope of this invention.

What is claimed is:

1. A low voltage floating power supply derived a high voltage source, comprising:

a positive high voltage source;

a negative high voltage source, an input voltage;

a first npn transistor with a collector connected to said positive high voltage source;

a first Zener diode with cathode connected to the emitter of said first npn transistor;

a second Zener diode with cathode connected to the anode of said first Zener diode;

a second npn transistor with collector connected the anode of said second Zener diode, a current source for sinking the emitter current of said second npn transistor to said negative high voltage source;

a bias regulator to add a fixed bias to the input voltage for biasing the base of said first npn transistor, a positive supply voltage obtained at the emitter of said first npn transistor;

a negative supply voltage obtained at the collector of said second npn transistor.

2. A floating low voltage supply as described in claim 1, wherein the base of said first npn transistor is biased from said positive high voltage through a first resistor, and the base of said second npn transistor is biased from said input voltage through a second resistor.

3. A floating low voltage supply as described in claim 1, further comprising a third resistor inserted between said positive high voltage source.

4. A floating low voltage supply as described in claim 1, wherein said bias regulator comprises a third Zener diode in series with a forward biased junction diode.

5. A floating low voltage supply as described in claim 1, wherein said current source comprises a fourth resistor connected between the emitter of said second npn transistor and negative high voltage source.

6. A floating low voltage supply as described in claim 5, further comprising a forward biased second diode and a third diode between the base of said second transistor and said negative high voltage source.

7. A floating low voltage supply as described in claim 4, wherein said first Zener diode, second Zener diode and the third Zener diode have the same Zener voltage.

8. A floating low voltage supply as described in claim 1, wherein said positive supply voltage and said negative supply voltage serve as the supply voltages of an operational amplifier operating as a voltage follower.

* * * * *